US006109726A

United States Patent [19]

Lee

[11] Patent Number: 6,109,726

[45] **Date of Patent: *Aug. 29, 2000**

[54] SERVICE STATION OF INK-JET PRINTER

[76] Inventor: Yong-Duk Lee, 416 Maetan-dong, Paldal-ku, Suwon, Kyungki-do, Rep. of Korea

[ * ] Notice: This patent is subject to a terminal disclaimer.

[21] Appl. No.: 08/829,443

[22] Filed: Mar. 28, 1997

[30] Foreign Application Priority Data

Mar. 28, 1997 [KR] Rep. of Korea ..... 96-6268

[51] Int. Cl.[7] ..... B41J 2/165

[52] U.S. Cl. ..... 347/33

[58] Field of Search ..... 347/22, 29, 30, 347/32, 33

[56] References Cited

U.S. PATENT DOCUMENTS

| | | | |
|---|---|---|---|
| 4,177,471 | 12/1979 | Mitchell | 347/37 |
| 4,577,200 | 3/1986 | Rix et al. | 347/49 |
| 4,638,331 | 1/1987 | Watanabe . | |
| 5,216,449 | 6/1993 | English . | |
| 5,260,724 | 11/1993 | Tomi et al. | 347/30 |
| 5,325,111 | 6/1994 | Dietl | 347/30 |
| 5,394,178 | 2/1995 | Grange | 347/32 |
| 5,424,728 | 6/1995 | Goldstein . | |
| 5,426,456 | 6/1995 | Kuelzer et al. . | |
| 5,448,270 | 9/1995 | Osborne . | |
| 5,471,230 | 11/1995 | Saito et al. . | |
| 5,517,219 | 5/1996 | Uchida | 347/24 |
| 5,530,463 | 6/1996 | Nystrom et al. . | |
| 5,563,637 | 10/1996 | Francis et al. | 347/32 |
| 5,612,721 | 3/1997 | Ishize | 347/22 |
| 5,627,573 | 5/1997 | Fahy | 347/32 |
| 5,801,725 | 1/1998 | Neese et al. | 347/32 |
| 5,847,728 | 12/1998 | Lee | 347/33 |

FOREIGN PATENT DOCUMENTS

| | | | |
|---|---|---|---|
| 363011347A | 1/1988 | Japan | 347/30 |
| 405330057A | 12/1993 | Japan | 347/30 |

*Primary Examiner*—John Barlow
*Assistant Examiner*—Michael S Brooke

[57] ABSTRACT

A service station device for an ink-jet printer wherein a case is disposed at a service area of the ink jet printer, and a capping member is moved along first guide slots formed at the case by a carriage moved to the service area. A wiping member is moved along second guide slots and along a slope guiding surface of a pair of guide plates of the case by the capping member, and the wiping member has a wiper for cleaning a surface of the nozzle while the nozzle is moved toward a printing area and the cap is returned to an initial position thereof. The wiping member is held in a position for cleaning the nozzle by a locking member moved together with the wiping member. The locking member is locked into a locker provided in the case, and returned to an initial position thereof by an elastic member of which one end is secured to the case when the carriage is moved to the printing area.

15 Claims, 3 Drawing Sheets

SERVICE STATION OF INK-JET PRINTER

CLAIM OF PRIORITY

This application makes reference to, incorporates the same herein, and claims all benefits accruing under 35 U.S.C. §119 from an application entitled Service Station of Ink Jet Printer earlier filed in the Korean Industrial Property Office on Mar. 28, 1996, and there duly assigned Ser. No. 6268/1996 by that Office.

BACKGROUND OF THE INVENTION

1. Field of the Invention

The present invention relates to a service station of an ink jet printer. More particularly, the present invention relates to a service station device of an ink jet printer by which a nozzle of the ink jet printer can be capped to be tightly closed and perfectly cleaned.

2. Description of the Related Art

A contemporary ink jet printer can include a carriage placed on a main frame and moved to the left or right by a belt, a head having a nozzle which sprays an ink in a specific form, which is loaded on the carriage and moved together with it. In addition, the ink jet printer can include a service station for cleaning and closing the nozzle in response to a cleaning signal in a predetermined cycle during its printing operation.

Such a service station can be constructed to be suited for the characteristics of each head of several kinds of ink jet printers. In the contemporary service station, the nozzle is moved toward a cap by the weight of the head and sealed by the cap. Thus, the nozzle is not necessarily closed perfectly. Furthermore, since the configuration of the service station is complicated, a lot of component parts and assembling steps are required, thereby increasing the production cost. Moreover, the conventional service station employs a separate motor for driving the cap to close and seal the nozzle. This also raises the price of the ink jet printer. A wiper which is provided in the service station to clean the nozzle surface is in poor contact with the nozzle, to thereby deteriorate its reliability. The wiper is moved up and down, not to right and left. This causes the traveling distance of the carriage during the cleaning and closing operations, so that a size of the service station should be enlarged. On the combating of this and related problems in capping the nozzle, an example of the contemporary practice, Osbourne (U.S. Pat. No. 5,448,270, Ink-Jet Printhead Cap Having Suspended Lip, Sep. 5, 1995) discusses a cap having a sealing lip. This extends peripherally around the expanse of the cap. Saito et al. (U.S. Pat. No. 5,471,230, Capping Means And Ink Jet Recording Apparatus Using The Same, Nov. 28, 1995) discusses a capping device having a pushing member provided on the capping member at an inner side thereof for pushing with pressure against the discharge port of the ink jet recording head. Nystrom et al. (U.S. Pat. No. 5,530,463, Integral Seal For Ink Jet Printheads, Jun. 25, 1996) discusses an integral seal for priming or maintaining the nozzles or orifices of an ink jet printhead in an inkjet printer. Kuelzer et al. (U.S. Pat. No. 5,426,456, Suction And Covering Device For Suctioning Ink From Ink Print Heads Of An Ink Jet Print Unit And For Sealing The Ink Jet Print Heads, Jun. 20, 1995) discusses a suction and covering device with rubber insert caps, each cap being associated with a duct for pressure compensation. English (U.S. Pat. No. 5,216,449, Bounded Capillary Vent System For Ink-Jet Printers, Jun. 1, 1993) discusses a capillary vent system for ink-jet printers having an ethylene propylene diene monomer element. From my study of the contemporary practice and art, I find that there is a need for an effective service station of an ink jet printer by which the nozzle can be elastically capped to be tightly closed and perfectly cleaned.

SUMMARY OF THE INVENTION

Therefore, an object of the present invention is to provide an effective service station of an ink jet printer by which the nozzle can be elastically capped to be tightly closed and perfectly cleaned.

To achieve this and other objects, the ink jet printer of the present invention comprises a carriage placed on a main frame and moved to right and left by a belt according to the guide of a belt pulley placed on both sides of the frame, and a head located on the carriage and moved together with it, on which a nozzle for spraying an ink in a specific form is provided. The nozzle is conveyed to the service station in response to a signal in a predetermined cycle to be cleaned and capped therein.

A service station of an ink jet printer in accordance with the present invention comprises a case disposed at a service area of the ink jet printer, and having a plurality of first and second guide slots formed respectively at upper and lower portions of side walls thereof, a pair of guide plates formed with a slope guiding surface at a top thereof, and a locker provided at one of the guide plates; a capping member moved along the first guide slots of the case by a carriage moved to the service area, and having a cap for sealing a nozzle provided in the carriage; a wiping member moved along the second guide slots of the case and along the slope guiding surface by the capping member, and having a wiper for cleaning a surface of the nozzle while the carriage is returned to an initial position thereof; and a locking member moved together with the wiping member and engaged with the locker to hold the wiper in a position for cleaning the nozzle, and returned to an initial position thereof by an elastic member of which one end is secured to the case when the carriage is returned to the initial position thereof.

The capping member has a pressing piece contacted with the carriage when the carriage is moved to the service area, two pairs of guide rods provided at both sides thereof to extend laterally and guided along the first guide slots of the case, a wall member positioned at an intermediate portion thereof, and a rectangular opening formed between the pressing piece and the wall member, and a cap positioned between the wall member and rear wall thereof and supported elastically by a spring.

The wiping member has a rectangular shape of a wiper guide which is longer in length and narrower in width than the capping member. The wiper guide has two pairs of guide rods, each pair of which are guided along the second guide slots and along the slope guiding surface of the pair of guide plates of the case, respectively, a catcher provided at a top surface thereof and extending upwardly, and a wiper supporter provided at a rear portion thereof for supporting the wiper.

The locking member includes a locking guide extending parallel with the wiping member, a pivot shaft extending laterally from a rear end portion of the locking guide to be guided along the second guide slots of the case, a claw engaged to the locker of the case, a releasing lever vertically extending from the pivot shaft, and pivoted about the pivot shaft when contacting with an actuating bar provided at the carriage, and a hook disposed opposite to the claw and securing one end of the elastic member. The pivot shaft is formed into a cylinder and surrounds one of guide rods positioned at a rear portion of the wiper guide. A top surface of the releasing lever is formed with an inclined surface such that the actuating bar of the carriage is smoothly passed when the carriage is moved to the service area from the printing area.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components.

DETAILED DESCRIPTION OF THE PREFERRED EMBODIMENT

Figure 1:
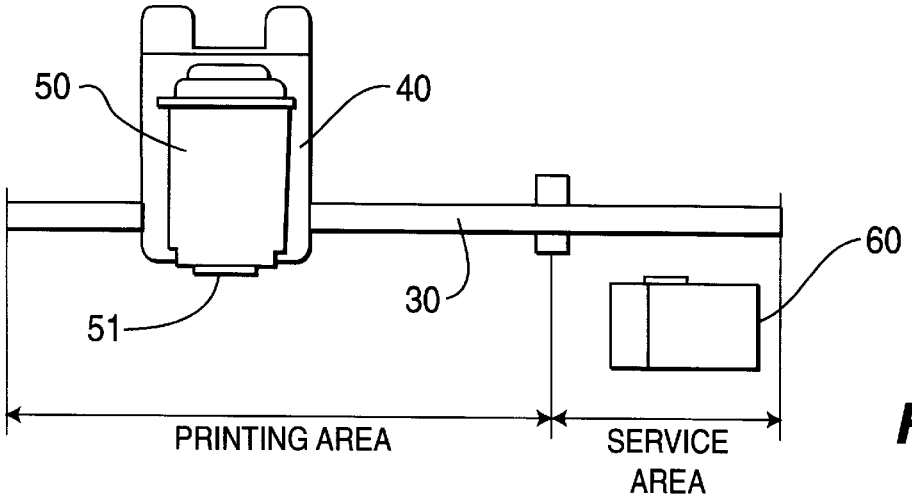
FIG. 1 shows a configuration of an ink jet printer according to the present invention.

Turning now to FIGS. 1 to 6, an ink jet printer of the present invention includes a carriage 40 placed on a main frame and moved to right and left by a belt 30 according to the guide of a belt pulley (not shown) placed on both sides of the frame, a head loaded on carriage 40 and moved together with it, on which a nozzle 51 for spraying an ink in a specific form is provided, and a service station 60 disposed at a service area for cleaning and closing the nozzle 51.

The service station 60 includes a case 610, a capping member 620, a wiping member 630, and a locking member 640.

Figure 2:
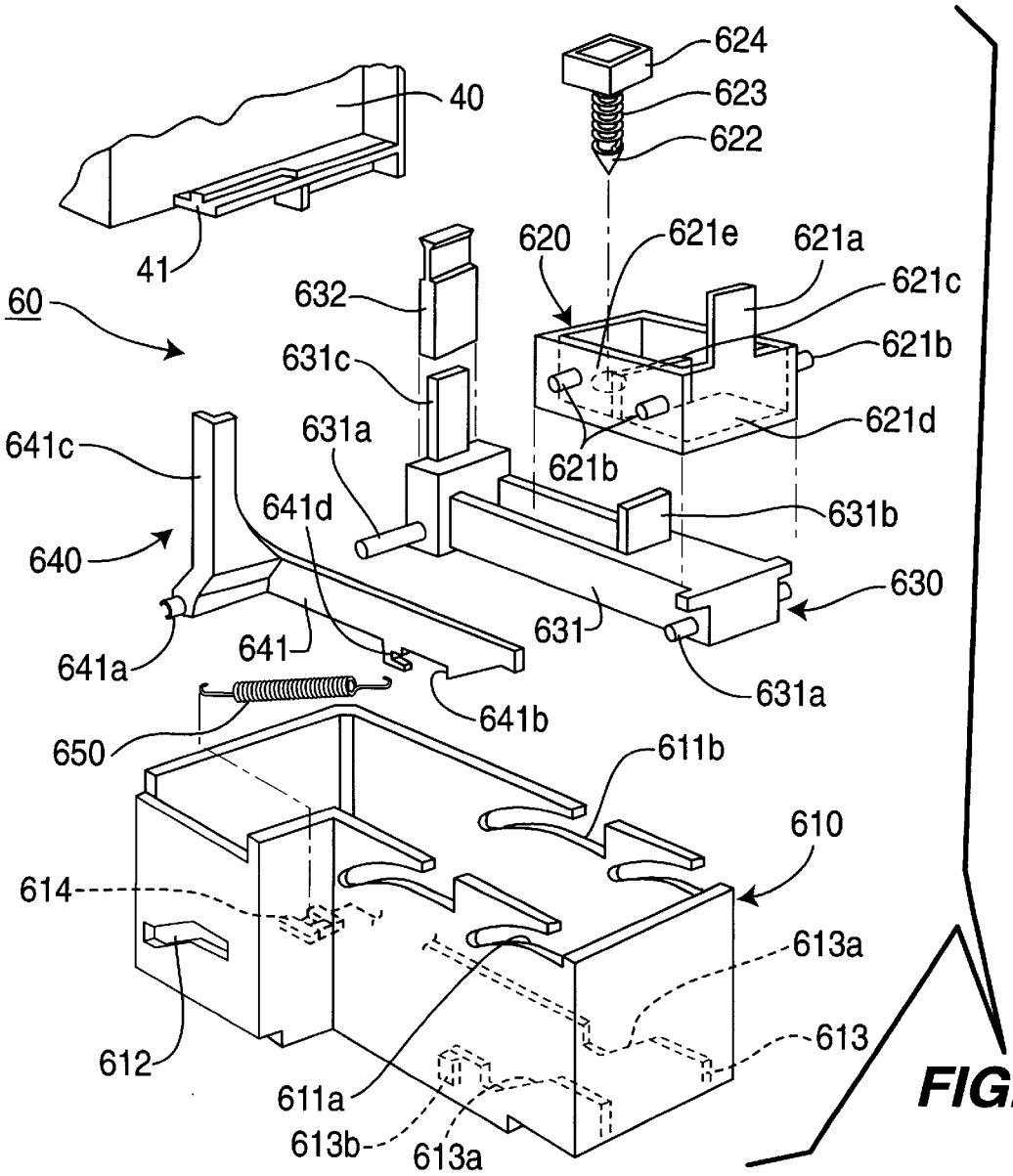
FIG. 2 is an exploded perspective view showing a service station of the ink jet printer according to the present invention.

The case 610, which is disposed at the service area of the ink jet printer, has first guide slots 611*a* and 611*b* formed at upper portions of both side walls thereof, second guide slots 612 formed of rear lower portions of both side walls, and a pair of guide plates 613 disposed therein, as shown in FIG. 2. The first guide slots 611*a* and 611*b* have an inclined surface which is raised upwardly and a horizontal surface, respectively. The guide plates 613 are disposed inside the case 610 parallel with both side walls thereof, respectively. Each of the guide plates 613 is formed with slope guiding surfaces 613*a* at a top surface thereof, the slope guiding surfaces 613*a* have a same shape as the second guide slots 612. A locker 613*b* is provided at one side of the guide plates 613.

The capping member 620 is a rectangular shape and is contained within the case 610. The capping member 620 has a cap 624 provided at a top surface thereof, a pressing piece 621*a* contacted with the carriage 40 when the carriage 40 is moved to the service area, two pairs of guide rods 621*b* which are provided at both sides thereof to extend laterally, a wall member 621*c* positioned at an intermediate portion thereof, a rectangular opening 621*d* formed between the pressing piece 621*a* and the wall member 621*c*. A hole 621*e* is formed between the wall member 621*c* and a rear wall thereof, and the cap 624 is inserted the hole 621*e*.

The cap 624 is made from soft materials such as rubber to have a shape for containing and sealing the nozzle 51 and has a cap rod 622 inserted and mounted to the hole 621*e*. The spring 623 is disposed around the cap rod 622 to force upwardly the cap 624. The guide rods 621*b* are slid along the first guide slots 611*a* and 611*b* of the case 610, respectively.

The capping member 620 is moved together with the carriage 40 and raised according to a shape of the first guide slots 611*a* and 611*b*, when the carriage 40 is to the service area for the next printing, to thereby elastically seal the nozzle 50.

The wiping member 630 includes a rectangular shape of wiper guide 631 which is longer in the length and narrower in the width than the capping member 620, and a wiper 632 provided in the wiper guide 631 for cleaning the nozzle 51, as shown in FIG. 2. The wiper guide 631 has two pairs of guide rods 631*a*, each pair of which are guided along the second guide slots 612 and the slope guiding surfaces 613*a* of the case 610, respectively, a catcher 631*b* provided at a top surface thereof and extending upwardly to be contained in the opening 621*d*, and a wiper supporter 631*c* provided at a rear portion thereof for supporting the wiper 632. The wiper 632 is preferably made from flexible materials such as rubber.

The wiping member 630 is moved together with the capping member 620 and raised by the slope guiding surfaces 613*a* and the second guide slots 612 when the capping member 620 is moved by the carriage 40.

The locking member 640 includes a locking guide 641 extending parallel with the wiper guide 631, a pivot shaft 641 a extending laterally from a rear end portion of the locking guide 641, a claw 641*b* engaged with the locker 613*b* of the case 610, a releasing lever 641*c* vertically extending from the pivot shaft 641*a*, and a hook 641*d* disposed opposite to the claw 641*b*. The pivot shaft 641*a* surrounds one of guide rods 631*a* positioned at the rear portion of the wiper guide 631. The hook 641*d* is for securing one end of an elastic member 650 of which other end is secured to other hook 614 provided at a bottom of the case 610.

A top surface of the releasing lever 641*c* is formed with an inclined surface such that an actuating bar 41 of the carriage is smoothly passed although the actuating bar 41 is contacted with the top surface of the releasing lever 641*c* when the carriage 40 is moved to the service area from the printing area. The locking member 640 is always pulled downwardly about the pivot shaft 641*a* by the elastic member 650.

Figure 3:
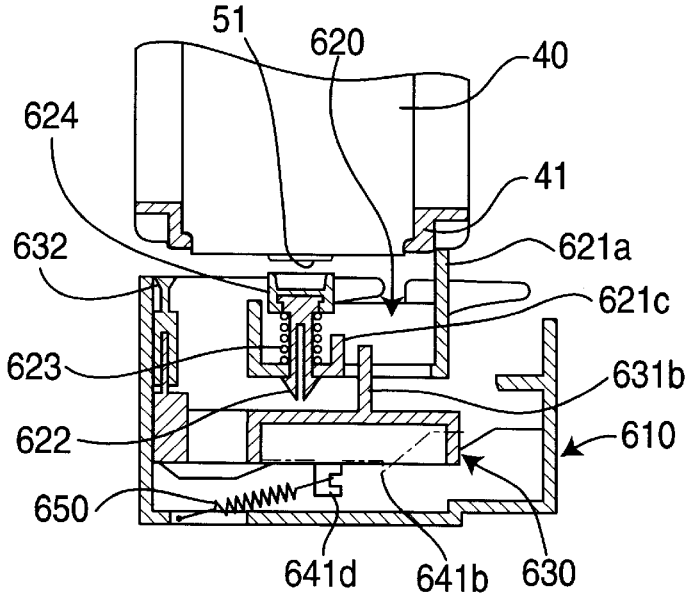
FIG. 3 is a cross-sectional view showing a state where a head of the ink jet printer is initially conveyed to the service station, in accordance with the present invention.

An operation of the ink jet printer of the present invention can be as follows. As shown in FIG. 3, when the carriage 40 is moved from the print area to the service area in response to a control signal, the pressing piece 621*a* of capping member 620 is contacted with a front portion of the carriage 40 and forced in the moving direction of the carriage 40 and moved together with the carriage 40 within the case 610. While the capping member 620 is moved together with the carriage 40, the capping member 620 is gradually raised to a position for capping the nozzle 51 since two pairs of the guide rods 621*b*, which are provided at both sides of the capping member 620, are guided along the first guide slots 611*a* and 611*b* provided in the case 610. As the capping member 620 is gradually raised, the cap 624 is also gradually raised to the capping position, simultaneously.

At this time, the wiping member 630 is at a standstill, and the wiper 632 is positioned lower than the nozzle 51, so that the nozzle 51 is not cleaned by the wiper 632 while the carriage 40 is moved to the service area from the printing area.

Figure 4A:
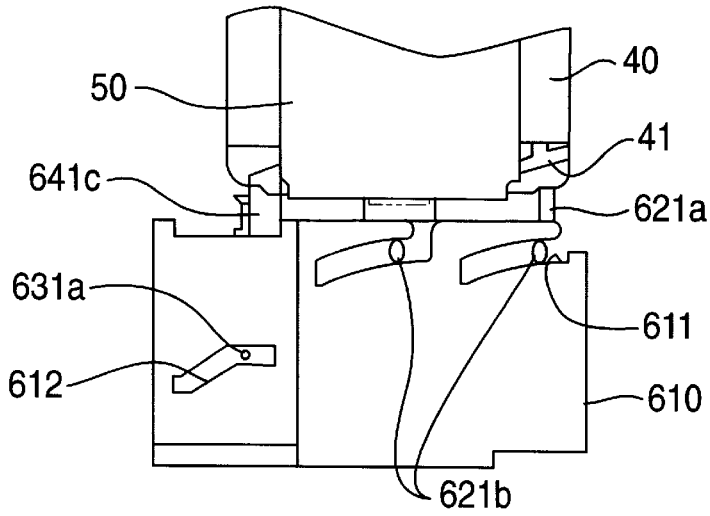
FIG. 4A is a front view showing a state where the head is capped by a cap shown in FIG. 3.
Figure 4B:
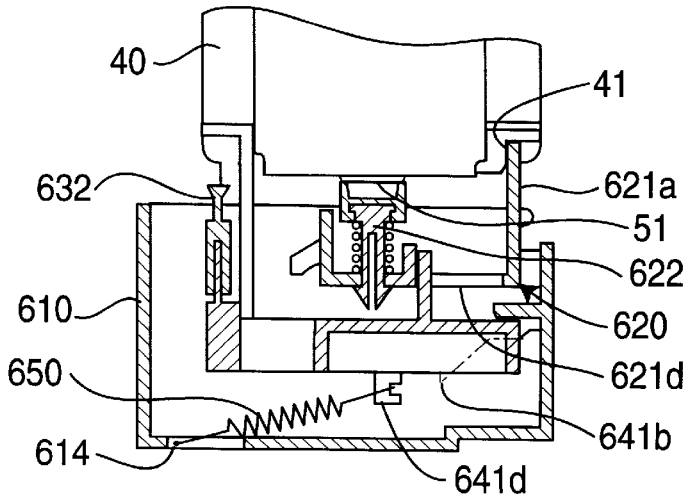
FIG. 4B is a cross-sectional view of FIG. 4A.

As the carriage 40 is continuously moved to the service area from the printing area, the capping member 620 also is moved together with the carriage 40 and gradually raised to the capping position as shown in FIGS. 4A and 4B by the carriage 40.

Here, the cap rod 622 is preferably designed such that the cap 624 can be raised over the position where the cap 624 caps the nozzle 51. However, the rasing of the cap 624 is stopped by the nozzle 51, so that the cap 624 is raised only by a predetermined height. The cap 624 supported by the spring 623 is lowered by a difference between a height where the cap 624 is designed to be raised and a height where the cap 624 is actually raised as the cap 624 is downwardly pressed by the nozzle 51 when the nozzle 51 is resiliently capped and sealed with the cap 624, in the position shown in FIGS. 4A and 4B.

The guide rods 621*b* of the capping member 620 are positioned at upper portions of the guide slots 611*a* and 611*b* and the guide rods 631*a* of the wiping member 630 are positioned at upper portions of the second guide slots 612 and the slope guiding surfaces 613*a* (not shown in FIGS. 4A and 4B) when the nozzle 51 is capped and sealed with the cap 624. An upper portion of the first guide slots 611*a* and 611*b* is opened, so that the guide rods 621*b* of the capping member 620 are easily inserted into the first guide slots 611*a* and 611*b*.

After the nozzle 51 is capped and sealed up by the cap 624, when the capping member 620 is moved to the position shown in FIGS. 4A and 4B by the carriage 40, the wiping member 630 begins to move to the position shown in FIGS. 4A and 4B by the capping member 620 as the catcher 631*b* of the wiping member 630, which is positioned within the opening 621*d* of the capping member 620, is forced to the position by the pressing piece 621*a*.

Accordingly, the guide rods 631*a* of the wiper guide 631 are gradually raised and then horizontally moved along the second guide slots 612 formed at both sides of the case 610 and the slope guiding surfaces 613*a* of the guide plates 613. Therefore, when the wiping member 630 is moved to the position by the capping member 620, the wiper 632 which is provided at the wiping member 630 also can be gradually raised and then horizontally moved to a position for cleaning the nozzle 51, according to the shapes of the second guide slots 612 and the slope guiding surfaces 613*a*.

The locking member 640 is gradually raised and horizontally moved together with the wiping member 630 against a pulling force of the elastic member 650 since the pivot shaft 641*a* thereof surrounds one of the guide rods 631*a* positioned at rear portion of the wiper guide 631, as above described. The claw 641*b* of the locking member 640 is engaged to the locker 613*b* provided at the bottom of the case 610 to lock the wiping member 630 in place when the wiper 632 of the wiping member 630 is positioned at a position for cleaning the nozzle 51, as shown in FIGS. 4A and 4B. In a state where the nozzle 51 is sealed by the cap 624, if the carriage 40 is returned to the printing area for printing in response to a control signal, the capping member 620 is slightly moved to the printing area by the carriage 40 until the sealing of the nozzle 51 by the cap 624 is released. Thereafter, the capping member 620 is moved and descended to an initial position thereof along the guide slots 611*a* and 611*b*, by the weight thereof.

Figure 5A:
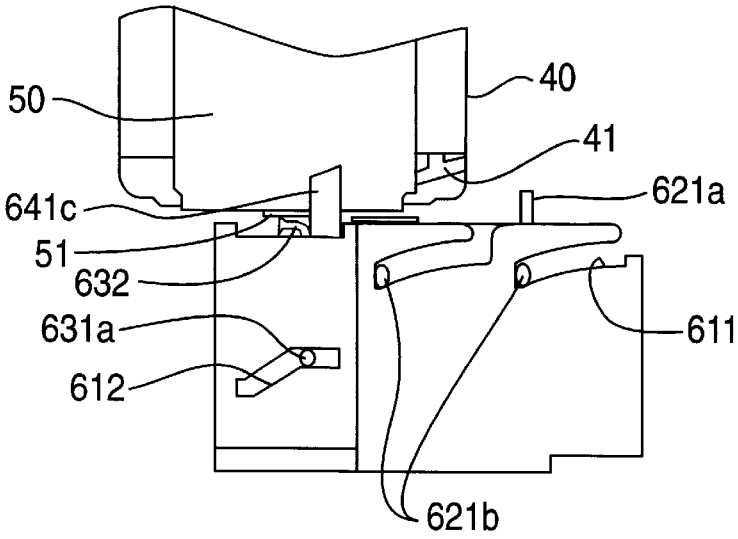
FIGS. 5A and 5B are views similar to FIGS. 4A and 4B showing a state where the head is cleaned by a wiper shown in FIG. 3 when the head is moved to the print area, respectively.
Figure 5B:
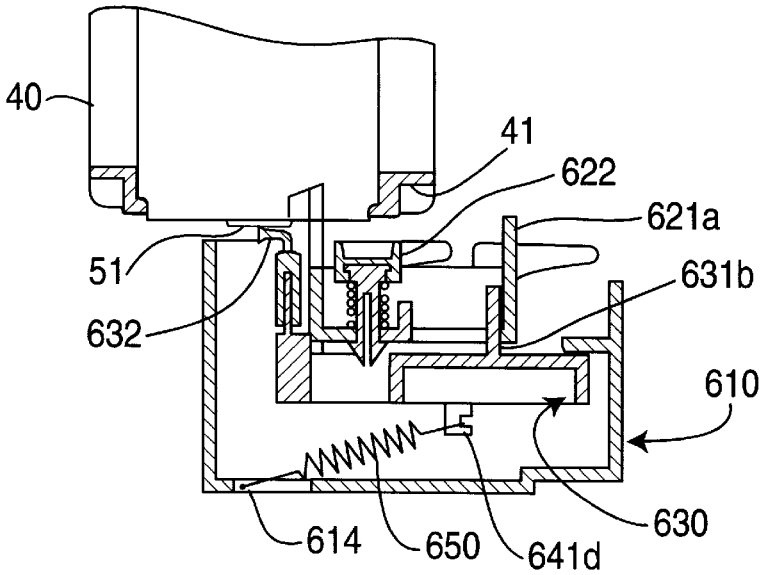

As the carriage 40 is continuously moved toward the printing area, the nozzle 51 is cleaned by the wiper 632 while the carriage 40 is moved to the printing area, as shown in FIG. 5A. The wiper 632 is bent in the moving direction of the carriage 40 by contacting with the carriage 40 since the wiper 632 is made from flexible materials such as rubber as above described when it cleans the nozzle 51.

Figure 6:
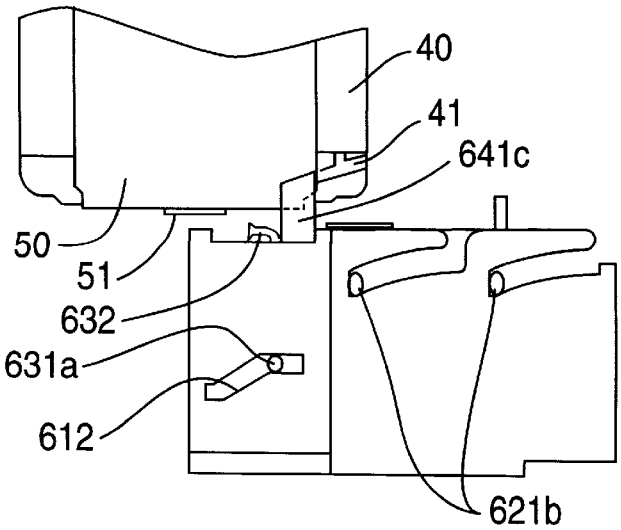
FIG. 6 is a front view showing a state that component parts of the service station are returned to the initial state by the head being conveyed to the print area before locking is released.

FIG. 6 is a front view showing a state that component parts of the service station are returned to the initial state by the head being conveyed to the print area before locking is released. If the carriage 40 is continuously moved to the printing area, the actuating bar 41 provided at the carriage 40 is contacted with the releasing lever 641*c* of the locking member 640 as shown in FIG. 6, and is pivoted about the pivot shaft 641*a* in the moving direction of the carriage 40.

As the locking member 640 is pivoted about the pivot shaft 641*a* in the moving direction of the carriage 40, the claw 641*b* is disengaged from the locker 613*b* of the case 610. The locking member 640 is returned to an initial position thereof by the pulling force of the elastic member 650. The wiping member 630 also is returned to an initial position thereof since the wiping member 630 is moved together with the locking member 640. The waste ink and particles removed from the nozzle 51 by the wiping part 630 are dropped from the case 610 to a felt and stored therein.

On the other hand, the carriage 40 can be moved to the printing area since the releasing lever 641*c*, i.e., the locking member 640 is pivoted in the moving direction of the carriage 40 although the actuating bar 41 is caught by the releasing lever 641*c* as shown in FIG. 6.

As discussed above, the above-described processes of closing the nozzle, cleaning the nozzle surface and storing the waste ink can be repeatedly performed, to thereby improve the quality of print. According to the present invention, the cap closes the nozzle by the elasticity of the spring which elastically supports the cap, not by the weight of the head, improving the reliability in sealing of the nozzle. Furthermore, the simple configuration of the service station reduces the steps of assembling it, and decreases the production cost thereof due to a lesser number of component parts than that of a conventional service station. Moreover, the wiper closely comes into contact with the nozzle surface so as to perfectly clean it, and it can be returned to the initial state when the carriage is moved to the print area. The traveling distance of the carriage for cleaning and sealing of the nozzle can be shortened by moving the wiper to appropriate positions, as necessary. This can decrease the size of the service station.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A service station of an ink jet printer, comprising:

a case disposed at a service area of the ink jet printer, said case having a plurality of first and second guide slots respectively formed at upper and lower portions of side walls of said case, a pair of guide plates each formed with a slope guiding surface at a top of each of the guide plates, and a locker provided at one of said guide plates;

a capping member positioned for movement along the first guide slots of said case and having a cap for sealing a nozzle of the ink jet printer;

a wiping member positioned for movement along the second guide slots of the case and along the slope guiding surface of the pair of guide plates of said case by said capping member, said wiping member having a wiper for cleaning a surface of the nozzle of the ink jet printer; and a locking member positioned for movement together with said wiping member and for engaging with said locker of said case to hold said wiper in a position for cleaning the nozzle, and for being returned to an initial position by an elastic member connected to said locking member and to said case.

2. The service station of an ink jet printer as claimed in claim 1, wherein said capping member has a pressing piece contacted with a carriage of the ink jet printer that conveys the nozzle of the ink jet printer, two pairs of guide rods, one of said two pairs of guide rods respectively provided at each of both sides of said capping member and respectively positioned for movement along said first guide slots of said case, a wall member positioned at an intermediate portion of said capping member, and a rectangular opening formed between said pressing piece and said wall member, and the cap positioned between said wall member and rear wall of said capping member and supported elastically by a spring.

3. The service station of an ink jet printer as claimed in claim 2, wherein an upper portion of said first guide slots of said case is opened, so that said two pairs of guide rods of said capping member are respectively easily inserted into corresponding ones of said first guide slots of said case.

4. The service station of an ink jet printer as claimed in claim 1, wherein said wiping member has two pairs of guide rods, each pair of guide rods of said wiping member are guided along the second guide slots and along the slope guiding surface of the pair of guide plates of said case, respectively, a catcher provided at a top surface of said wiping member and extending upwardly, and a wiper supporter provided at a rear portion of said wiping member for supporting said wiper.

5. The service station of an ink jet printer as claimed in claim 4, wherein said wiper is made from a flexible material.

6. The service station of an ink jet printer as claimed in claim 4, wherein said wiping member is longer in length and narrower in width than said capping member.

7. The service station of an ink jet printer as claimed in claim 4, wherein said catcher extends into an opening of said capping member, such that said catcher is forced in a moving direction of said capping member when said capping member is moved, and a wall member of the capping member positioned at an intermediate portion of said capping member is forced in a moving direction of said wiping member when said wiping member is returned to an initial position.

8. The service station of an ink jet printer as claimed in claim 1, wherein said locking member includes:

a locking guide extending parallel with said wiping member;

a pivot shaft extending laterally from a rear end portion of said locking guide and positioned for movement along said second guide slots of said case;

a claw on the locking guide for engaging to said locker of the case;

a releasing lever vertically extending from said pivot shaft, and pivoted about said pivot shaft when contacting with an actuating bar provided on a carriage of the ink jet printer that conveys the nozzle of the ink jet printer; and a hook on the locking guide disposed opposite to the claw and securing one end of said elastic member.

9. The service station of an ink jet printer as claimed in claim 8, wherein said pivot shaft is formed into a cylinder and surrounds one of guide rods positioned at a rear portion of said wiping member.

10. The service station of an ink jet printer as claim in claim 8, wherein a top surface of said releasing lever is formed with an inclined surface such that the actuating bar of the carriage is smoothly passed.

11. The service station of an ink jet printer as claimed in claim 1, wherein said first and second guide slots each have an inclined surface which is raised upwardly and a horizontal surface connected with the inclined surface, respectively, and said slope guiding surface of said pair of guide plates has a same shape as said second guide slots.

12. A service station of an ink jet printer, comprising:

a case disposed at a service area of the ink jet printer, said case having a plurality of first and second guide slots formed respectively at upper and lower portions of side walls of said case, a pair of guide plates each formed with a slope guiding surface at a top of each of the guide plates, and a locker provided at one of said guide plates;

means for capping and sealing a nozzle, the nozzle being mounted in a carriage of said ink jet printer, the means for capping and sealing positioned for movement along the first guide slots of said case;

means for cleaning the nozzle positioned for movement along the second guide slots and along the slope guiding surface of the pair of guide plates of said case by said means for capping and sealing; and means for locking said means for cleaning the nozzle in a position for cleaning the nozzle and positioned for movement together with said means for cleaning the nozzle, and said means for locking being returned to an initial position by an elastic member connected to said means for locking and to said case.

13. The service station of an ink jet printer as claimed in claim 12, wherein said means for capping and sealing has a pressing piece contacted with the carriage of the ink jet printer that conveys the nozzle, two pairs of guide rods, one of said two pairs of guide rods respectively provided at each of both sides of said means for capping and sealing and respectively positioned for movement along said first guide slots of said case, a wall member positioned at an intermediate portion of said means for capping and sealing, and a rectangular opening formed between said pressing piece and said wall member, and a cap positioned between said wall member and rear wall of said means for capping and sealing and supported elastically by a spring.

14. The service station of an ink jet printer as claimed in claim 13, wherein an upper portion of said first guide slots of said case is opened, so that said two pairs of guide rods of said means for capping and sealing are respectively easily inserted into corresponding ones of said first guide slots of said case.

15. The service station of an ink jet printer as claimed in claim 12, wherein said first and second guide slots have an inclined surface which is raised upwardly and a horizontal surface connected with the inclined surface, respectively, and said slope guiding surface of said pair of guide plates has a same shape as said second guide slots.

* * * * *